United States Patent [19]

Ono et al.

[11] Patent Number: 4,882,220

[45] Date of Patent: Nov. 21, 1989

[54] FIBROUS STRUCTURES HAVING A DURABLE FRAGRANCE

[75] Inventors: Akira Ono, Tokyo; Toshikazu Fuse, Nagahama; Osamu Miyamoto, Tottori; Shoso Makino, Hikone; Yoshihisa Yamato, Shiki; Hiroshi Kametani, Kurayoshi; Susumu Tokura, Osaka; Hiromi Tanaka, Hikone; Toru Ito; Hitomi Nakao, both of Nagahama; Shuji Tokuoka, Takatsuki; Toshihide Takeda, Hikone, all of Japan

[73] Assignee: Kanebo, Ltd., Tokyo, Japan

[21] Appl. No.: 302,435

[22] Filed: Jan. 26, 1989

[30] Foreign Application Priority Data

| | | | |
|---|---|---|---|
| Feb. 2, 1988 | [JP] | Japan | 63-23444 |
| Apr. 11, 1988 | [JP] | Japan | 63-88669 |
| Apr. 27, 1988 | [JP] | Japan | 63-105766 |
| May 12, 1988 | [JP] | Japan | 63-115617 |
| May 18, 1988 | [JP] | Japan | 63-121140 |
| May 19, 1988 | [JP] | Japan | 63-122299 |
| Jun. 15, 1988 | [JP] | Japan | 63-145687 |

[51] Int. Cl.[4] ..... B32B 5/16

[52] U.S. Cl. ..... 428/240; 428/223; 428/323; 428/402; 428/405; 428/407; 428/905

[58] Field of Search ..... 428/283, 405, 407, 904, 428/905, 913, 240, 323, 402

[56] References Cited

U.S. PATENT DOCUMENTS

| | | | |
|---|---|---|---|
| 4,493,869 | 1/1985 | Sweeny et al. | 428/905 |
| 4,514,461 | 4/1985 | Woo | 428/905 |
| 4,746,567 | 5/1988 | Zelter | 428/905 |
| 4,769,264 | 9/1988 | Dreger | 428/905 |

FOREIGN PATENT DOCUMENTS

| | | |
|---|---|---|
| 52-31200 | 3/1977 | Japan . |
| 53-049200 | 5/1978 | Japan . |
| 53-106885 | 9/1978 | Japan . |
| 0111200 | 9/1978 | Japan . |
| 53-47440 | 12/1978 | Japan . |
| 57-117647 | 7/1982 | Japan . |
| 60-7723 | 2/1985 | Japan . |
| 60-215869 | 10/1985 | Japan . |
| 1401143 | 7/1975 | United Kingdom . |

*Primary Examiner*—James J. Bell

*Attorney, Agent, or Firm*—Flynn, Thiel, Boutell & Tanis

[57] ABSTRACT

A fragrant fibrous structure, such as fabrics, apparels or the like, provided with microcapsules encapsulating a perfume and a resinous binder, preferably a silicone resin in a weight ratio of 2/1 to 1/5, an add-on amount in the aggregate of said microcapsules and resinous binder being 0.3~7.0% based on the weight of the portion to which said microcapsules and resinous binder are adhered, of the fibrous structure. The process for preparing the above fibrous structures comprises applying a treating liquid comprising microcapsules composed of an external wall of a formaldehyde based resin enclosing a perfume and a resinous binder, preferably a low temperature reactive organopolysiloxane prepolymer emulsion, preferably together with a pressure absorbing agent, to at least a part of a fibrous structure and then drying the fibrous structure at a temperature of less than 150° C. to fix said microcapsules on fiber surfaces of the fibrous structure.

11 Claims, 3 Drawing Sheets

FIBROUS STRUCTURES HAVING A DURABLE FRAGRANCE

BACKGROUND OF THE INVENTION

1. Field of the Invention

The present invention relates to fibrous structures having a durable fragrance, particularly, textile fabrics, knitted goods and apparel provided with a durable fragrance by adhering microcapsules containing fragrances or essences thereto, and a process for preparing the same.

2. Description of the Prior Art

As regards fibrous structures such as apparel or the like having fragrance, various articles have been heretofore developed and many have been placed on the market. However, most of them have been such articles that are prepared by applying, for example, by spraying or coating, a fragrant material, such as perfume or the like, together with a binder or size, onto final products in the course of finishing, under an open atmospheric system, or by enveloping fragrant paper in packages when packing or by enclosing paddings made of fragrant paper to transfer its scent to the textile fabrics, knitted goods or apparel.

However, needless to say fragrant fibrous structures, such as apparel obtained by a method as mentioned above, have been poor in durability of fragrance and very low in commercial value as the fragrance entirely vanishes by only one washing. Moreover, there have been even some cases where the fragrance can remain for no more than a few hours after wearing of the fibrous structures as the perfumes or essences instantaneously evaporate if once the fibrous structures are brought into contact with the ambient atmosphere when they are worn. Further, with regard to the transfer of scent from the fragrant paper or paddings to the apparel, etc. in packages, there have been experienced some cases where the imparted scent varies in intensity in accordance with the lapse of time after sealing of the packages, consequently not presenting a pleasant scent so that the article itself becomes defective.

In order to eliminate such problems, an attempt has been made to apply a fragrant substance in a closed system, namely, as encapsulated in microcapsules, onto fibrous structures and then to convert the closed system to an open system by rupture of the microcapsules owing to stresses applied thereto to emit fragrance during using of the fibrous structures. For example, there have been proposals, such as a method of applying a mixture of microcapsules encapsulating a liquid toilet preparation with a sizing bath containing a melamine resin to a fabric (British Patent Specification No. 1,401,143); a method of adhering microcapsules encapsulating a perfume with the aid of a capsule remover mainly comprising a cationic organic substance such as quaternary ammonium salts or the like and a nonionic organic substance such as sorbitan esters or the like (Japanese Patent Application Laid-open No. 52-31,200); a method for preparing fragrant towel fabrics by applying a liquid mixture of microcapsules containing a perfume with an acrylic resin to a towel fabric (Japanese Patent Application Laid-open No. 58-4,886); a method for preparing printed fabrics emitting fragrance by printing a printing paste compounded with a thermoplastic material, a thickening agent and microcapsules having a starch envelope membrane encapsulating a perfume (Japanese Patent Application Laid open Nos. 53-47,440 and 53-49,200); a method for preparing printed fabrics emitting fragrance by thermo-transfer printing a binder layer comprising a pigment, high molecular resin, microcapsules of a perfume, etc. to a fabric (Japanese Patent Application Laid-open No. 53 106,885); etc.

However, in such hitherto proposed methods wherein microcapsules are applied with a size or resinous binder to textile fabrics or knitted goods, drying or heating at relatively a low temperature yields a poor adhesiveness of the binders, resulting in a poor resistance to washing9. Alternatively, whereas heat-fixing at a high temperature after drying improves the adhesiveness, it has shortcomings such that denaturing of perfumes or collapsing of microcapsules caused by vaporization of perfumes occurs due to the high temperature as well as the hand of the fabrics becomes stiff due to infiltration into the fabrics of the resin. Particularly in sheer woven or knitted fabrics, such as women's hosiery, the component yarns consist of nylon filaments with a smooth surface so that it is very difficult to adhere the microcapsules sufficiently. If a large quantity of binder is applied in an attempt only to increase an adhesion amount, the hand also becomes so stiff as to impair the commercial value of the fabrics.

Further, adhesion by a thermotransfer printing as disclosed in Japanese Patent Application Laid-open No. 53-106,885 cannot provide a sufficiently durable fragrance and, moreover, perfumes generally evaporated or denatured at 150° C. or more present a problem such that perfumes that are durable in the thermotransfer printing are limited.

Furthermore, important problems encountered in most of those prior art techniques are that the materials employed for the sizes or binders, particularly, most of the nitrogen containing organic compounds, tend to spoil the fragrance due to their inherent unpleasant scents.

SUMMARY OF THE INVENTION

An object of the present invention is to provide fibrous structures with a durable, pleasant fragrance, without impairing their basic physical properties such as hand, color-fastness or the like.

Namely, the present invention is, in fibrous structures to which microcapsules encapsulating a perfume are adhered, a fragrant fibrous structure provided with the microcapsules and a resinous binder, preferably a silicone resin, in a weight ratio between 2:1 and 1:5, said microcapsules and said resinous binder being adhered in an amount of 0.3~7.0% in the aggregate based on the weight of the adhered portion of the fibrous structure.

Further, the process for preparing the above fibrous structures according to the invention comprises applying a treating liquid comprising microcapsules composed of an external wall of a formaldehyde based resin enclosing a fragrant substance and a resinous binder selected from the group consisting of: a low temperature reactive organopolysiloxane prepolymer emulsion; a low temperature reactive blocked isocyanate prepolymer emulsion and a metallic salt of a fatty acid; an acrylic or methacrylic emulsion obtained by emulsion polymerization of a monomer containing at least one vinyl group; a polyalkylene polymer emulsion; a polyester resin emulsion formed from a polyhydric alcohol and a polybasic acid; and a polyurethane resin emulsion formed from a diisocyanate and a polyol; preferably together with a pressure absorbing agent, to at least a part of a fibrous structure and then drying the fibrous structure at a temperature of less than 150° C. to fix said microcapsules on fiber surfaces of the fibrous structure.

Further, as a preferred process for preparing the fragrant fibrous structure of the invention, there is presented a process for applying, by means of soaking, padding, coating or printing, a treating agent, that is, a mixture of microcapsules encapsulating a perfume with a resinous binder, to a fibrous structure that has been subjected in advance to a water-repellent treatment.

In fibrous structures, such as: nonwoven, woven or knitted fabrics impregnated with a polyurethane based elastomer; synthetic leather substitutes having a grain side formed by a wet or dry process; suede-like synthetic leather substitutes made of a nonwoven fabric or a napped, woven or knitted fabric, composed of ultrafine fibers, being impregnated with a polyurethane based elastomer followed by buffing; artificial fur-like fabrics consisting of a base fabric and piles bonded and fixed thereto with latex, which piles consist of thick and long, preferably tip attenuated, guard hairs and thin and short underhairs; carpets consisting of a base fabric and pile yarns bonded and fixed thereto with latex; or the like; the fragrant microcapsules can be provided onto fibers not only by means of binders but also by incorporating the microcapsules into the abovementioned polyurethane based elastomer, solution for the grain layer, latex or the like.

Further, if there are employed fibrous structures comprising ultra fine fibers of preferably 0.7 denier or less/filament, such as those obtained from fibrillating type composite filaments as described hereinafter, the microcapsules encapsulating a perfume can be firmly retained only by trapping them between fibers or in interstices of the fibrous structures, without using binders as mentioned above.

DESCRIPTION OF THE PREFERRED EMBODIMENTS

Throughout the specification of this invention, the term "fibrous structures" is to be understood to include yarns, threads, woven fabrics, knitted goods, nonwoven fabrics, pile fabrics, furs, leathers, secondary products thereof, for example, outerwear such as suits, coats, kimonos, uniforms, sweaters, skirts, slacks, cardigans, sportswear, blouses, dress shirts, shorts, casual wear or the like, and underwear such as pajamas, lingerie, foundation garments hosiery or the like, bedclothes, such as mattress covers, bedcovers, sheets, blankets, counterpanes or the like, carpets, wall coverings, upholstery, automobile sheets, gloves, ties, scarves, glass wiping cloths, shawls, obis, and the like. The heavier the-unit weight of those fibrous structures, the more advantageous is the invention in relation to the water-repellent treatment.

As component fibers of the above structures, any fibers or yarns consisting of natural fibers, regenerated fibers, synthetic fibers, or combinations thereof produced by blend spinning, plying, mixed weaving or the like, may be employed. In relation to adhesiveness of binders, fibers having a rugged surface, such as cotton, porous fibers having microvoids and the like, or fibers having a compatibility with binders are advantageous. Particularly, ultra-fine synthetic fibers of 0.7 denier or less/filament, for example, fibrillating type composite filaments as described in Japanese Patent Application Laid-open Nos. 57-117,647 and 60-215,869, are very advantageously employed. By the term "fibrils" we mean ultrafine denier filaments a plurality of which, oriented in a bundle are made up into a fiber. The fibrils can be readily obtained by splitting composite filaments consisting of a plurality of components into individual components or by removing components easily soluble or decomposable by alkalis, acids, solvents, or the like.

Figure 1:
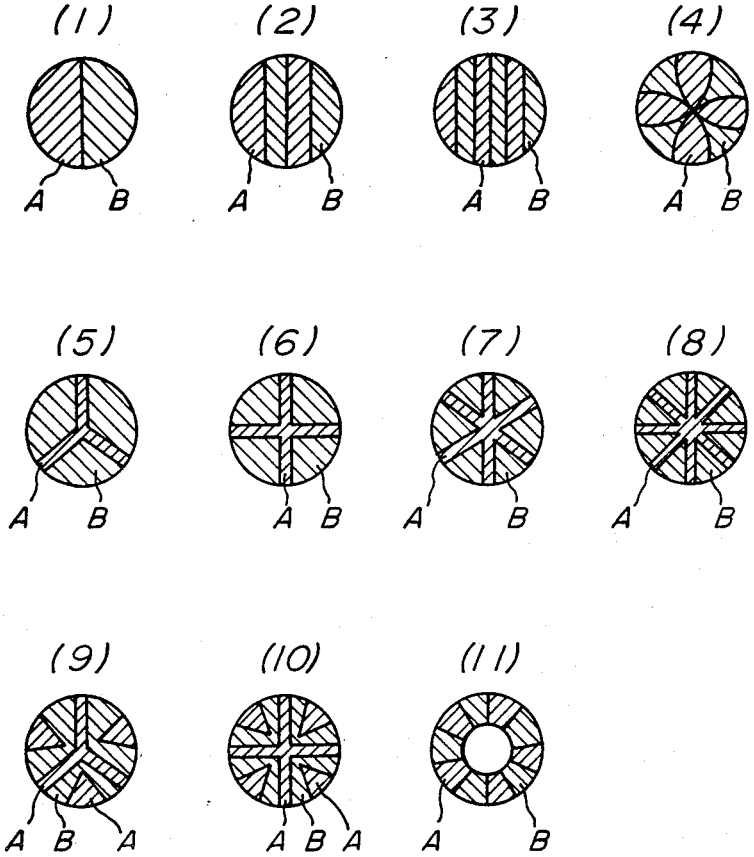
FIG. 1 shows the cross-sectional shapes of examples of fibrillating type composite filament to be used in a preferable embodiment of the present invention, wherein A and B indicate different components, respectively, constituting the filament.

The fibrillating type composite filament in the present invention is to be understood to mean a filament consisting of at least two polymer components selected from the group consisting of various polyesters, various polyamides, polyethylene and polypropylene, particularly, a polyamide and a polyester, wherein those polymer components are bonded with each other along the longitudinal axis of the filament in such a fashion that in the cross-section of the filament one component does not completely surround the others. As embodiments of such a composite filament, mention may be made of: a side by side type composite filament as shown in FIG. 1, (1); a side by side repeated type composite filament as shown in FIG. 1, (2) and (3); a composite filament as shown in FIG. 1, (4)~(8), consisting of one component having radially extended projections and another component filling up the spaces between the projections; a composite filament as shown in FIG. 1, (9) and (10), consisting of one component having radially extended projections, another component filling up the spaces between the projections and having a centripetally directed V-type recess in every filling up portion and the same component as the former, filling up the V-type recesses; and a side by side repeated type composite filament having a central hollow as shown in FIG. 1, (11); or the like.

As a polyamide, mention may be made of, for example, nylon-4, nylon-6, nylon-7, nylon-11, nylon-12, nylon-66, nylon-610, polymetaxylylene adipamide, polyparaxylylene decanamide, poly-bis-cyclohexylmethane decanamide, copolyamides thereof, and the like.

Alternatively, preferred examples of the polyesters include polyethylene terephthalate, polytetramethylene terephthalate, polyethylene oxybenzoate, poly-1,4-dimethyl cyclohexane terephthalate, polypivalolactone, copolyesters thereof, and the like.

The conjugate ratio of polyamide component and polyester component is generally in the range between 0.05 and 0.95.

In FIG. 1, it is preferred that A is a polyamide and B is a polyester, however, that is not limitative.

In order to achieve satisfactorily a trapping of microcapsules, the fibrillating type composite filament is preferred to be split by fibrillation into ultrafine filaments of 0.7 denier or less/filament, particularly 0.5 denier or less/filament.

By the term "fibrillation" we mean that when the fibrillating type composite filament has, for example, a cross-section as shown in FIG. 1, (3), every bonded component separates to produce 6 fibrils consisting of 3 segment fibrils of one component and another 3 segment fibrils of the other component and, further, that in the case where the composite filament has, for example, a cross-section as shown in FIG. 1, (6), the components also separate into 5 fibrils consisting of one segment fibril of one component having a cruciform cross section and 4 segment fibrils of the other component having a fan-shaped cross-section. Alternatively, even if the fibrillating type composite filament has any other cross-sectional shape, its fibrillated state will be readily deduced from the above descriptions.

Fibrillating type composite filaments as mentioned above can be used as crimped yarns or crimp potential yarns and, inter alia, the crimp potential yarns are preferred. The crimp potential yarns can be manufactured by twisting, heat setting and untwisting the abovementioned composite filament yarns to produce crimped yarns and then heat setting again the crimped yarns substantially under tension.

The abovementioned fibrillating type composite filaments alone or in combination with other fibers can be made up into fibrous structures. As the other fibers, any appropriate synthetic filaments can be used without specific limitations. Polyester yarns are particularly preferred and, inter alia, polyester yarns of 1.5 deniers or less/filament, preferably, 1.0 denier or less/filament, are most preferred. Alternatively, natural fibers and regenerated cellulosic fibers also can be used. In woven fabrics, typically, the fibrillating type composite filament yarns are used in weft and ordinary yarns comprising synthetic fibers, natural fibers or regenerated cellulosic fibers are used in warp.

The fibrillation can be effected by applying a physical force or by a chemical treatment such as swelling of polymer components, in accordance with any known processes. Alternatively, there is also known a method to remove by dissolving one component to provide remaining ultrafine fibers (Japanese Patent Application Publication No. 60 7723).

Interstices formed between ultrafine fibers in fibrous structures are preferred to be predominantly 20μ or less in size. Additionally, the cross-section of individual filaments of the ultrafine fiber yarns is particularly preferred to be angular rather than circular. By virtue of such narrow interstices and angular cross-sections of the ultrafine fibers, fibrous structures can trap and firmly retain microcapsules without using special sizes, binders, etc. For this purpose, fibrous structures comprising the ultrafine fibers are preferred to have an interstice ratio of at most 80%, particularly at most 50%. Here, the interstice ratio is defined by the following formula:

$$\text{Interstice ratio (\%)} = \frac{\text{Weight of fibrous structure (g)}}{\text{Length(cm)} \times \text{Width(cm)} \times \text{Thickness(cm)} \times \text{Density(g/cm}^3)} \times 100$$

Additionally, the ultrafine fibers are preferred to be contained in an amount of at least 30%, particularly at least 50%, by weight, based on the total fibers.

The microcapsules encapsulating a perfume to be used in the present invention may have any composition, etc. insofar as they can rupture by an adequate abrasion to emit fragrance.

The microencapsulating process itself is well known in the art. From the standpoint of sustained releasability of fragrant substances and physical strength of microcapsules, envelope or external wall materials are preferred to be organic polymers, for example, polyurethanes, urea-formaldehyde resins, melamine-formaldehyde resins, cyclodextrin or the like. Those are not specifically limited and, however, inter alia, the urea formaldehyde resins and melamine-formaldehyde resins, particularly, low in formaldehyde content, are most preferred.

The size of the microcapsules is usually 1~50μ, preferably 5~20μ, in average diameter. Particularly preferably, a major portion of the particle diameter distribution is in the range between 5 and 15μ.

Particularly, in the case of the wall material being a urea-formaldehyde resin, the particle diameter is 2~50μ, preferably 5~20μ, and wall thickness is 0.1~20μ, preferably 0.5~4μ, while in the case of the wall material being a melamine-formaldehyde resin the particle diameter is 5~50μ, preferably 5~20μ, and wall thickness is 0.2~30μ, preferably about 0.5~6μ.

The fragrant substances employed in this invention include natural and synthetic fragrances, perfumes, scents and essences and any other simple substances and mixtures of liquid or powdery compounds emitting fragrance. As the natural fragrances, there are presented fragrances of animal origin, such as musk, civet, castreum, ambergris or the like, and fragrances of vegetable origin, such as lemon oil, rose oil, citronella oil, sandalwood oil, peppermint oil, cinnamon oil or the like. Alternatively, as the synthetic fragrances, there are presented mixed fragrances of, for example, α-pinene, limonene, geraniol, linalool, lavandulol, nerolidol or the like. The fragrant substances are contained in an amount of, preferably 5~99%, particularly 50~95%, by weight, based on the total weight of the microcapsule.

Silicone resin based binders, the most preferably employable binders in this invention, display a coating effect and play a role as adhesives between microcapsules and fibrous structures. The silicone resin based binders are particularly preferred to be of silicone aqueous emulsion type binders that are excellent in dispersibility in water and easy to dilute with water, for example, comprising an organopolysiloxane as a main component which has been emulsified with an emulsifier. Those binders are hardened upon removal of the water and form a rubbery membrane having features of silicone rubbers, which displays a durable adhesive effect.

More preferable organopolysiloxane emulsions are low temperature reactive type organopolysiloxane prepolymer emulsions. An example of the low temperature reactive type organopolysiloxane emulsions is a silicone aqueous emulsion consisting of 100 parts of an organopolysiloxane having at least 2 hydroxyl groups bonding to silicon atoms in one molecule or its derivative, 1~60 parts of a homogeneous dispersion liquid consisting of 0.1~10 parts of a reaction product of an amino-functional silane or its hydrolyzate with an acid anhydride and 1~50 parts of colloidal silica, 0.01~10 parts of a catalytic hardenr, 0.3~20 parts of an anionic emulsifier and 25~600 parts of water, by weight.

Alternatively, as a binder to be employed in this invention, a low temperature reactive blocked isocyanate prepolymer emulsion can be used in combination with a metallic salt of a fatty acid.

As the low temperature reactive blocked isocyanate prepolymer, mention may be made of a prepolymer obtained by polymerizing an acrylic or methacrylic compound with a modified acrylic or methacrylic compound such as silico-modified, fluoro-modified or the like. Such a prepolymer has at least one blocked isocyanate group in one molecule which group reacts with sodium bisulfite, acetyl acetone, ethyl acetoacetate, diethyl malonate or the like to form temporarily a stable compound which thermally dissociates upon a post heat treatment to reproduce the isocyanate group.

Alternatively, the metallic salt of a fatty acid is a catalyst for promoting the dissociation of the blocked isocyanates, for example, zinc caprylate, zirconium caprylate, zinc laurate, zinc stearate, or the like.

Further, as the binder, emulsions of an acrylic or methacrylic compound that are obtained by emulsion polymerization of a monomer containing at least one vinyl group also can be employed. Those are emulsions of an emulsion polymerization product of, for example, acrylic acid, methacrylic acid, methyl acrylate, methyl methacrylate, ethyl acrylate, ethyl methacrylate, butyl acrylate, butyl methacrylate, acrylonitrile, acrylamide, N-methylol acrylamide, 2-hydroxyethyl acrylate, 2-hydroxybutyl acrylate or the like.

Further, polyalkylene emulsions, emulsions of a polyester resin from a polyhydric alcohol and a polybasic acid, or emulsions of a polyurethane from a diisocyanate and a polyol also can be employed as the binder. There are exemplified as the polyalkylene, polyethylene, polypropylene of the like; as the polyhydric alcohol, ethylene glycol, 1,4-butane diol, 1,6-hexane diol, diethylene glycol, trimethylol propane or the like; as the polybasic acid, phthalic acid, adipic acid, maleic acid, trimellitic acid, terephthalic acid or the like.

Furthermore, as the isocyanate, mention may be made of hexamethylene diisocyanate, xylylene diisocyanate, tolylene diisocyanate, 4,4'-diphenylmethane diisocyanate, 1,5-naphthalene diisocyanate or the like and as the polyol, polyethylene adipate, polypropylene adipate, polybutylene adipate, polyethylene phthalate, polyethylene glycol, polypropylene glycol, poly(ethylene/propylene) glycol or the like. The polyurethane resin emulsions composed of the above compounds form aqueous insoluble resins through a drying treatment.

The above described binders are preferred to contain a pressure absorbing agent. The pressure absorbing agent is a compound selected from: emulsions containing a poly(organic carboxylic acid) such as polyacrylic acid, copolymer of acrylic acid with an acrylate or the like; compounds to form a salt with an alkaline substance such as ammonia, soda ash or the like; neutralized products of an organic polycarboxylic acid, such as sodium salt of polyacrylic acid, ammonium salt of polyacrylic acid, aminosalt of polyacrylic acid or the like; neutralized products of a copolymer of acrylic acid with an acrylate; polyalkylene glycols such as polyethylene glycol, polypropylene glycol or the like; compounds obtained by substituting terminal groups of an alkylene glycol such as polyethylene glycol, polypropylene glycol or the like with alkyl groups, $C_nH_{2n+1}$ (n is an integer of 1~25); and polyvinyl pyrrolidone.

Microcapsules containing a fragrant substance as described hereinbefore are added to a treating bath comprising the aforementioned emulsion and preferably a pressure absorbing agent and then applied to fibrous structures. In this instance, it is preferred to adjust the pH of the treating bath to 5~10, preferably 6~9, with soda ash, sodium bicarbonate, ammonia, or the like.

When the application is conducted by means of padding, spraying and soaking and squeezing, an aqueous treating bath containing 0.1~10%, preferably 0.2~5.0%, of the microcapsules enclosing a fragrance substance, 0.1~20%, preferably 0.5~5.0%, of the abovementioned emulsion and, if required, 5% or thereabouts of the pressure absorbing agent, by weight, may be applied with a pick-up rate of 10~200%, preferably 40~150%, by weight. Particularly when the aformentioned blocked isocyanate prepolymer emulsions are used, the metallic salt of a fatty acid is preferred to be used together in an amount of 0.5~30%, preferably 5~15%, based on the blocked isocyanate, by weight.

Alternatively, when a printing or coating method is used, an aqueous solution or emulsion containing 0.1~10%, preferably 0.2~5.0% of the microcapsules containing a fragrant substance, 1~95%, preferably 5~95%, of the aforementioned emulsion and 5% or thereabouts of the pressure absorbing agent, by weight, is preferred to be applied after adjusting the viscosity (with BM type viscometer, at 20° C.) to 2,000~8,000 cps in the case of printing, or 8,000~16,000 cps in the case of coating.

In any case, the binder is applied in an amount of 0.5~5 times, preferably 1~3 times, by weight of the weight the microcapsules, to display a sufficient adhesive effect. If the amount is less than 0.5 time, the coating effect will be low, while if it exceeds 5 times, the adhesion rate of the microcapsules remains substantially unchanged and, conversely problems are presented such as undesirable hand of woven or knitted fabrics or apparel or unpleasant odor depending on kind of the resin used, so that it is not preferred. Further, the aggregate add-on amount of both the above microcapsules and binder is usually 0.3~7.0%, preferably 0.5~5.0%, by weight, based on the weight of the portion of the fibrous structure to which the microcapsules and binder are adhered. Namely, a sufficient amount of the microcapsules is adhered to the fibrous structure by applying the binder in the above described ratio. Therefore, if the aggregate add-on amount of both the above is less than 0.3%, both the intensity and durability of fragrance will be insufficient, while if it is more than 7.0%, the hand of the fibrous structure will be affected and, moreover, there will be present a problem such that a too strong scent will be emitted all at once, so that neither case will be preferred. Namely, the above specified addon amount will meet all requirements for providing fibrous structures with desirable hand and softness together with a pleasant scent which has an adequate durability and is not interfered with by other odors.

Application of the binders IS preferred to be conducted on final products of fibrous structures, such as apparel or the like, which are not further processed. The application may be conducted by soaking the fibrous structure in a treating bath comprising a binder and then dewatering and drying in such a manner that the hand may not be impaired.

In the case where the fibrous structures contain the aforementioned ultrafine fibers, microcapsules can be applied to the fibrous structures, without using binders as described above, by dispersing the microcapsules in a liquid vehicle, preferably water, and then impregnating the fibrous structures with the resulting dispersion. However, in order to further increase washing durability so that the microcapsules may not remove during washing, the above microcapsule dispersion can further contain sizes, binders as mentioned above, or the like.

Such a size or binder is used not necessarily in a large amount and a sufficient amount is, for example, about 0.1~2% by weight based on the dispersion. From the standpoint of yet further augmenting the resistance to washing, organic polymer binders such as polyurethane elastomers, silicone resins, polyacrylic resins, polyurethane/urea elastomers or the like, are more preferred than sizing agents.

After thus applying the emulsion to the fibrous structures, a drying treatment at a temperature lower than 150° C. is conducted to fix the microcapsules on the surfaces of fibers. As an embodiment of the drying treatment, mention may be made of drying at a temperature of 60° C. to less than 150° C., preferably 80° C. to 130° C., for 10 seconds to 30 minutes, preferably 30 seconds to 10 minutes, or such a drying treatment followed by a heat treatment at a temperature of 80° C. to less than 150° C., preferably 100° C. to 130° C., for 10 seconds to 10 minutes, preferably 30 seconds to 5 minutes.

Further, a combined use of a usual finishing agent, such as a softening agent, hand controlling agent, dye fixing agent, reactive resin, condensation resin, catalyst, pre-finishing agent or the like, will present no specific problems with respect to the effects of the invention. Additionally, a combined use of a pigment in an amount of 10% or less by weight also presents no specific problems with respect of the effects of the invention.

According to treatments as described above, a durable, pleasant fragrance can be provided to fibrous structures without impairing their hand and feeling. However, in the case where a substantially transparent treating bath is used, it is desired to conduct a water repellent treatment before the above described treatments, in order to restrain discoloration of the portion to which the treating bath is applied. Additionally, the water repellent treatment prevents permeation of the binder into the fibrous structure. In consequence, hardening of the hand of the fibrous structures is prevented and furthermore lowering of the strength is also restrained.

As such a water repellent, mention may be made of any compounds that can provide fibrous structures with water repellency, for example, wax emulsions comprising a solid ester and the like formed from a higher fatty acid and a higher alcohol, such as natural waxes, derivatives thereof, e.g., carnauba wax, candelilla wax or the like, and synthetic waxes; silicone emulsions comprising dimethyl polysiloxane, its derivatives or the like; polyolefin emulsions comprising polyethylene, polypropylene or the like, cationic quaternary ammonium compound emulsions; and synthetic resin emulsions comprising homo- or co-polyamides, homo-or co-polyacrylic or the like.

Additionally, the water repellent treatment may be conducted, for example, by padding an aqueous solution or emulsion comprising 0.1~10%, preferably 0.5~5.0%, by weight, of water repellents used alone or in combination at a pick up rate of 10~120%, preferably 40~80%, by weight, and drying at a temperature of 80°~190° C., preferably 120°~170° C.

The present invention displays effects as follows by virtue of the construction described hereinabove.

On the outset, since fibrous structures, such as apparel are provided with microcapsules containing a fragrance, the microcapsules are ruptured, little by little, during wearing of the fibrous structures or by an intentional abrasion, and emit a pleasant scent. Accordingly, the scent is not a kind that is emitted all at once and then instantly vanishes, but rather, it possesses a sufficient durability.

Alternatively, compounding of the microcapsules with a binder resin at an adequate ratio extremely improves the bonding and adhesion abilities of the microcapsules, whereby the objective add-on amount and durability of pleasant scent are obtained.

Further, the process of the invention wherein a treating bath comprising a mixture, in an appropriate ratio, of microcapsules with a binder is applied then followed by a heat treatment, can provide fibrous structures, such as woven or knitted fabrics, apparel or the like, with a durable, pleasant scent without impairing an inherent hand of the fibrous structures and without requiring complicated processing steps.

Namely, by selecting microcapsules, binders, pressure absorbing agents, treating temperatures, etc. as defined hereinabove according to the present invention, there are realized fibrous structures provided with microcapsules which are scarcely ruptured in the course of processing and are sufficiently and gradually ruptured to emit an adequate fragrance when they are used (worn). Particularly, the use of silicone binders obviates a problem such that unpleasant odors of the binders interfere with the fragrances.

Further, though the adhesiveness to fibrous structures of macrocapsules is good, there happens no case where the hand of the fibrous structures is rather impaired due to the good adhesiveness. Particularly, if the water repellent treatment is conducted prior to the fragrance imparting treatment, deteriorations of the hand, color shade and strength are prevented.

Specifically, in view of the fact that heretofore the fibrous structures comprising ultrafine fibers have been extremely deficient in durability and if the durability is improved the hand has become harsh, the effect of the present invention is prominent in such fibrous structures, as such fibrous structures having fragrances according to the present invention are provided with a durability in fragrance without impairing the hand or without presenting a problem of interference of unpleasant odors of binders.

The present invention will be explained in more detail by way of example hereinafter.

EXAMPLE 1

Ten kinds of dyed woven fabrics, knitted goods and apparel listed hereinbelow were subjected to a water repellent treatment according to a conventional process (with a water repellent softening agent comprising methyl hydrogen polysiloxane as a main ingredient). Further, a 10 g/l aqueous dispersion of urea resin microcapsules containing a jasmine flower perfume (an average particle diameter of 8 μm, a wall thickness of 1 μm) was admixed with a 10 g/l (or 20 g/l) silicone aqueous emulsion comprising an epoxy modified dimethyl polysiloxane resin as a main ingredient. Then, the woven fabrics, knitted goods and apparel were soaked (printed or patted) in the resulting emulsion containing the above microcapsules and centrifuged to dewater, followed by drying and heating in wet at 120°~130° C. for 1 minute. The woven fabrics, knitted goods and apparel to which the microcapsules containing the perfume were adhered were forwarded to drying, finishing and setting steps to prepare fragrant woven fabrics, knitted goods and apparel, according to a conventional ① Interlock with an Ne 40/2 cotton yarn.

② Single jersey with an Ne 40/2 cotton yarn.

③ Sweater knit with a colored Ne 18/4 cotton yarn.
④ Cardigan knit with a colored Ne 18/4 yarn of 50% cotton and 50% water absorbent porous acrylic.
⑤ Twill fabric woven with an Ne 40 blend yarn of 65% polyester and 35% rayon (122×79/inch).
⑥ Dobby cloth woven with an Ne 45 blend yarn of 50% polyester and 50% cotton (120×76/inch).
⑦ Black dyed fabric of front georgette crepe and back satin (220×87/inch) woven with 75d/36f false twisted blend yarns of ordinary spun filaments having a U type cross section and high speed spun filaments having a circular cross-section.
⑧ Silk Habutae 14 momme (60.2 g/m$^2$).
⑨ Plain weave fabric woven with 48/2 count woolen yarns.
⑩ Silk crepe de Chine 12 momme (51.6 g/m$^2$).

Then, the above knitted fabrics ① and ② were made up into a sports coat and a sports shirt, respectively. The woven fabrics ⑤ and ⑥ were made up into dress shirts and ⑦ was into a formal wear. The fabrics ⑧ and ⑨ were made up into ties and ⑩ was made into a scarf. Then, these articles were dry-cleaned and tested for durability and hand. The test for resistance to dry cleaning was carried out in accordance with JIS L 0217, No. 401 and determined by the cleaning frequency until the fragrance has vanished. Further, the evaluation of the fragrance was marked by ten panelists into five grades (emitting optimal fragrance ... 0, strong ... +1 and too strong ... +2, and weak ... −1 and too weak ... −2) and their mean values were adopted. Alternatively, with regards to the hand, those felt by also ten panelists to be good, a little inferior and inferior were marked as 0, −1 and −2, respectively, and determined by their mean values.

The results are shown in Table 1.

they possess a durable, pleasant scent as well as a good hand.

EXAMPLE 2

The below described two kinds of stockings were knit and dyed followed by a fixing treatment. Then, those dyed stockings were treated in the same manner as Example 1.

Test article ①: panty hose.
Leg portion . . . 15d/3f false-twisted woolly nylon yarn.
Panty and tow portions . . . 30d/8f false-twisted woolly nylon yarn.
Test article ②: panty hose (support type).
Leg portion . . . (20×13×13 DCY)×13d/3f raw silk yarn.
Panty portion . . . (20×30 POY)×30d/8f woolly nylon yarn.
Tow portion . . . 13d/3f raw silk yarn ×30d/8f woolly nylon yarn ×70d/18f woolly nylon yarn.
Coating material: silicone aqueous coating material, Shin-Estu Silicone KM-2002T (trade name of an organopolysiloxane prepolymer emulsion manufactured by Shin-Etsu Chemical Co., Ltd.)
Buffering agent: Ultra MT (trade name of sodium phosphate based buffering agent manufactured by Mitejima Kagaku Kogyo Ltd.).
Softening agent; durable water absorbing softener, San Softener TAFF A, San Softener TAFF B and CAT F-50 (manufactured by Sanyo Chemical Industries Ltd.) . . . 2% owf.

The test for resistance to washing was carried out in accordance with JIS L 0217, No. 103 and determined by the washing frequency until fragrance has vanished. Further, the evaluation of the fragrance was marked by

TABLE 1

| Test Article | Microcapsules: Binder | Application Method | Add-on (%) | Resistance to Washing (frequency) | Fragrance | Hand | Remarks |
|---|---|---|---|---|---|---|---|
| ① Sports coat | 1:2 | Printing | 2.1 | 11 | O(−1∼1) | O(0∼−1) | Present invention |
| ② Sports shirt | 1:2 | Printing | 2.1 | 12 | O(−1∼1) | O(0∼−1) | Present invention |
| ③ Sweater | 1:1 | Soaking | 1.4 | 8 | O(−1∼1) | O(0∼−) | Present invention |
| ④ Cardigan | 1:1 | Soaking | 1.4 | 14 | O(−1∼1) | O(0∼−1) | Present invention |
| ⑤ Dress shirt | 1:1 | Padding | 1.4 | 10 | O(−1∼1) | O(0∼−1) | Present invention |
| ⑥ Dress shirt | 1:1 | Padding | 1.4 | 9 | O(−1∼1) | O(0∼−1) | Present invention |
| ⑦ Formal wear | 1:1 | Padding | 1.4 | 10 | O(−1∼1) | O(0∼−1) | Present invention |
| ⑧ Tie | 1:2 | Padding | 2.1 | 11 | O(−1∼1) | O(0∼−1) | Present invention |
| ⑨ Tie | 1:1 | Padding | 1.4 | 10 | O(−1∼1) | O(0∼−1) | Present invention |
| ⑩ Scarf | 1:2 | Padding | 2.1 | 10 | O(−1∼1) | O(0∼−1) | Present invention |
| ③' Sweater (no water-repellent treatment) | 1:1 | Soaking | 1.4 | 10 | O(−1∼1) | Δ(−1∼−2) | Present invention |
| ③ Sweater | 1:9 | Soaking | 7.0 | 20 or more | Δ(−1∼−2) | X(−2) | Comparative Example |
| ③ Sweater | 4:1 | Soaking | 0.9 | 3 | X(2) | O(0∼−1) | Comparative Example |
| ①' Sports coat (no water-repellent treatment) | 1:2 Binder: Printing Paste | Printing | 2.1 | 5 | Δ(−1∼−2) | Δ(−1∼−2) | Comparative Example |

From the results shown in Table 1, it will be clear that the fragrant apparel according to the present invention have achieved the object of the invention, namely, ten panelists into five grades (emitting optimal fragrance . . . 0, strong . . . +1 and too strong . . . +2, and weak . . . −1 and too weak . . . −2) and their mean values were adopted. Alternatively, with regards to the hand, only those felt by ten panelists to be particularly inferior were checked and the number of checks was present.

The results are shown in Table 2.

TABLE 2

| Test Article | Weight before Treatment (g) | Micro-capsules: Coating Material | Pressure Absorbent g/l | pH | Weight after Treatment (g) | Add-on (g) | Add-on Weight Wt. after Treatment (%) | Resistance to Washing (Frequency) | Fragrance | Hand |
|---|---|---|---|---|---|---|---|---|---|---|
| | Item | | | | | | | | | |
| ① | 14.3 | 2:3 | 0.3 | 4 | 14.9 | 0.6 | 4.0 | 5 | 0 | 1 |
| ① | 14.3 | 3:2 | 0.3 | 4 | 14.5 | 0.2 | 1.4 | 2 | −1 | 0 |
| ① | 14.3 | 1:3 | 1.0 | 3 | 14.7 | 0.4 | 2.7 | 4 | 0 | 4 |
| ① | 14.3 | 1:1 | 0.1 | 7 | 14.4 | 0.1 | 0.7 | 1 | −2 | 0 |
| ② | 22.2 | 1:1 | 0.2 | 5 | 22.7 | 0.5 | 2.2 | 3 | 0 | 0 |
| ② | 22.2 | 1:2 | 0.3 | 4 | 23.5 | 1.3 | 5.5 | 7 | +1 | 1 |
| ② | 22.2 | 2:1 | 0.3 | 4 | 22.5 | 0.3 | 1.3 | 2 | −1 | 0 |
| ② | 22.2 | 2:3 | 0.1 | 7 | 22.6 | 0.4 | 1.8 | 2 | −1 | 1 |

From the result, it will be clear that the fragrant panty hoses according to the present invention have achieved the object of the invention, namely, they possess a durable, pleasant scent as well as a good hand.

In Examples below, test methods for various properties were as follows:

(1) Tearing strength JIS L 1096, Method D.
(2) Resistance to washing JIS L 0217, No. 103.
(3) Resistance to dry cleaning JIS L 0217, No. 401.
(4) Fragrance marked by ten panelists into the following six grades and presented by their mean values.
5: optimal scent,
4: a little decreased,
3: about a half,
2: sensible a litte,
1: hardly sensible, and
0: no scent.
(5) Discoloration K/S concentration.

$$K/S=(1-R)^2/2R,$$

wherein R is a maximum absorption wavelength in spectrophotometer.

O: variation of K/S concentration of less than 3%,
Δ:variation of K/S concentration of 3∼10%, and
x: variation of K/S concentration of more than 10%.

EXAMPLE 3

A printed cotton plain weave fabric having a weight of 70 g/m$^2$ and a yarn density of Ne 60 warp×Ne 60 weft being 90×88/inch was obtained through conventional scouring, bleaching, mercerizing and printing processes.

This printed fabric was padded at a pickup rate of 70% with an aqueous treating bath containing 3% by weight of Bicron 29 (trade name of a cationic softening agent manufactured by Ipposha Oil Industries Co., Ltd.) and 1% by weight of Light-Silicone R-167 (trade name of a silicone based softening agent manufactured by Kyoeisha Yushi, Ltd.) and then dried at 130° C. for 1 minute.

On the other hand, 1% by weight of an aqueous dispersion containing 46% by weight of microcapsules with a particle diameter of 5∼15μ (average 10μ) composed of an external wall of a urea-formaldehyde resin enclosing 91% by weight of Fragrance BA 7985 (trade name of Jasmine type synthetic fragrance manufactured by Takasago International Corp.), and 3% by weight of an organopolysiloxane prepolymer emulsion, KM-2002T, were incorporated into water to prepare an aqueous treating liquid. After padding the above treated fabric at a pickup rate of 70% by weight with this aqueous treating liquid, drying at 120° C. for 2 minutes was conducted.

The test results of tearing strength, durability of the fragrance and discoloration of the obtained cotton plain weave fabric are shown in Table 3.

EXAMPLE 4

One percent by weight of an aqueous dispersion containing 46% by weight of microcapsules with a particle diameter of 5∼15μ (average 10μ) composed of an external wall of a urea-formaldehyde resin enclosing 91% by weight of Fragrance BA-7985, and 3% by weight of Voncoat R-3020 (trade name of an acrylic emulsion manufactured by Dainippon Ink & Chemicals Co., Ltd.) were incorporated into water to prepare an aqueous treating bath.

The same cotton plain weave fabric as that used in Example 3 was padded at a pickup rate of 70% by weight with this aqueous treating bath, and dried at 120° C. for 2 minutes.

The test results of tearing strength, durability of the fragrance and discoloration of the obtained cotton plain weave fabric are shown in Table 3.

COMPARATIVE EXAMPLE 1

The test fabric obtained in Example 3 was continually subjected to a further heat setting at 150° C. for 3 minutes.

The test results of tearing strength, durability of the fragrance and discoloration of the obtained cotton plain weave fabric are also shown in Table 3.

TABLE 3

| | Weft Tearing Strength (g) | Fragrance | | | Dis-coloration |
|---|---|---|---|---|---|
| | | Initial | 3 washings | 10 washings | |
| Control | 640 | — | — | — | — |
| Example 3 | 830 | 4.8 | 4.9 | 3.8 | O |
| Example 4 | 680 | 4.9 | 4.5 | 3.5 | O |
| Comparative Example 1 | 490 | 2.8 | 0.8 | 0.4 | x |

EXAMPLE 5

A printed Fuji silk plain weave fabric having a weight of 62 g/m$^2$ and a yarn density of N 140/2 spun silk warp×N 66 spun silk weft being 114×89/inch was obtained through conventional scouring, bleaching, mercerizing and printing processes.

This printed plain weave fabric was padded at a pickup rate of 80% with an aqueous treating bath containing 5% by weight of Silicolan ES-10 (trade name of a silicone based softening gents manufactured by Ipposha Oil Industries Co., Ltd.) and then dried at 130° C. for 1 minute.

On the other hand, a printing paste having a viscosity of 6800 cps (measured with BM type viscometer at 20° C.) was further prepared from 1% by weight of an aqueous dispersion containing 48% by weight of microcapsules with a particle diameter of 4~14μ (average 9.5μ) composed of an external wall of a ureaformaldehyde resin enclosing 89% by weight of sandalwood oil (a synthetic, mixed perfume manufactured by Takasago International Corporation), 5% by weight of KM-2002T and 94% by weight of an emulsion paste (a printing paste formulated with kerosine oil, water and polyethylene glycol distearate in a proportion of 50/50/2). Using the resulting printing paste containing the above microcapsules and flat screens of 120 mesh, the above treated print fabric was screen printed and then dried at 130° C. for 1 minute.

With regard to the resultant Fuji silk fabric, the test results of tearing strength, durability of the fragrance and discoloration are shown in Table 4.

EXAMPLE 6

A printing paste having a viscosity of 7200 cps (measured with BM type viscometer at 20° C.) was prepared from 1% by weight of an aqueous dispersion containing 48% by weight of microcapsules with a particle diameter of 4~14μ (average 9.5μ) composed of an external wall of a urea-formaldehyde resin enclosing 89% by weight of sandalwood oil (a synthetic, mixed perfume, manufactured by Takasago International Corporation), 5% by weight of Rikensol A-105 (a trade name of an acrylate based binder, manufactured by Mikiriken Industry Co., Ltd.) and 94% by weight of the same emulsion paste as that used in Example 5. Using the resulting printing paste containing the above microcapsules and flat screens of 120 mesh, the same Fuji silk fabric as that used in Example 5 was screen-printed and then dried at 130° C. for 1 minute.

With regard to the obtained Fuji silk fabric, the test results of tearing strength, durability of the fragrance and discoloration are shown in Table 4.

COMPARATIVE EXAMPLE 2

The test fabric obtained in Example 5 was continually subjected to a further heat setting at 150° C. for 3 minutes.

With regard to the obtained Fuji silk fabric, the test results of tearing strength, durability of the fragrance and discoloration are shown in Table 4.

TABLE 4

| | Weft Tearing Strength (g) | Fragrance | | | Dis-coloration |
|---|---|---|---|---|---|
| | | Initial | 3 Dry cleanings | 10 Dry cleanings | |
| Control | 1435 | — | — | — | — |
| Example 5 | 1823 | 4.6 | 4.7 | 4.8 | O |
| Example 6 | 1650 | 4.7 | 4.5 | 3.9 | O |
| Comparative Example 2 | 1120 | 3.2 | 1.2 | 0 | x |

EXAMPLE 7

An Ne 36 cotton/acrylic, 50/50 blended yarn was scoured, bleached and dyed in accordance with conventional processes. Using the above yarn, a sweater, cardigan and skirt were knit and sewn.

The sweater, etc. were soaked for 30 minutes in an aqueous treating bath containing 1% by weight of Silicolan ES-10 and 2% by weight of Yodosol PE-400 (trade name of a polyethylene emulsion manufactured by Kanebo NSC, Ltd.), and centrifuged to dewater to a pickup rate of 95% by weight, followed by drying at 80° C. for 20 minutes.

On the other hand, 0.7% by weight of an aqueous dispersion containing 52% by weight of microcapsules having a particle diameter of 12~18μ (average 15μ) composed of an external wall of a melamine-formaldehyde resin enclosing 90% by weight of a lemon lime type perfume (a synthetic, mixed perfume manufactured by Takasago International Corporation) and 2% by weight of KM-2002L-1 (trde name of an organopolysiloxane prepolymer emulsion manufactured by Shin-Etsu Chemical Co., Ltd.) were incorporated into water to prepare an aqueous treating bath. The above treated sweater, etc. were soaked in this aqueous treating bath for 1 minute and then centrifuged to dewater to a pickup rate of 80% by weight. After setting style, the sweater, etc. were dried in an oven drier at 95° C. for 10 minutes.

With regard to the resulting sweater, cardigan and skirt, the test results of resistance to washing of fragrance are shown in Table 5.

TABLE 5

| | | Frangrance | | | Dis-coloration |
|---|---|---|---|---|---|
| | | Initial | 3 washings | 10 washings | |
| Example 7 | Sweater | 4.8 | 4.7 | 3.7 | O |
| | Cardigan | 5.0 | 4.6 | 4.1 | O |
| | Skirt | 4.6 | 4.8 | 3.5 | O |

EXAMPLE 8

A dyed cotton plain weave fabric having a weight of 70 g/m$^2$ and a yarn density of Ne 60 warp ×Ne 60 weft being 90×88/inch was obtained through conventional scouring, bleaching, mercerizing and dyeing processes.

On the other hand, three kinds of printing pastes (A), (B) and (C) were prepared from (A) 0.2%, (B) 1.0% and (C) 3.0%, by weight, respectively, of an aqueous dispersion containing 47% by weight of microcapsules with a particle diameter of 5~15μ (average 10μ) composed of an external wall of a urea-formaldehyde resin enclosing 92% by weight of Fragrance SH-3037 (trade name of synthetic lavender type perfume manufactured by Takasago International Corporation), 5% by weight of KM-2002L-1 and (A) 94.8%, (B) 94% and (C) 92%, by weight, respectively, of a pressure absorbing agent comprising 5% by weight of sodium polyacrylate having a molecular weight of 720,000.

The aforementioned dyed cotton plain weave fabric was screen-printed with each of the above printing pastes by a 120 mesh flat screen and then dried at 130° C. for 1 minute.

Figure 2A:
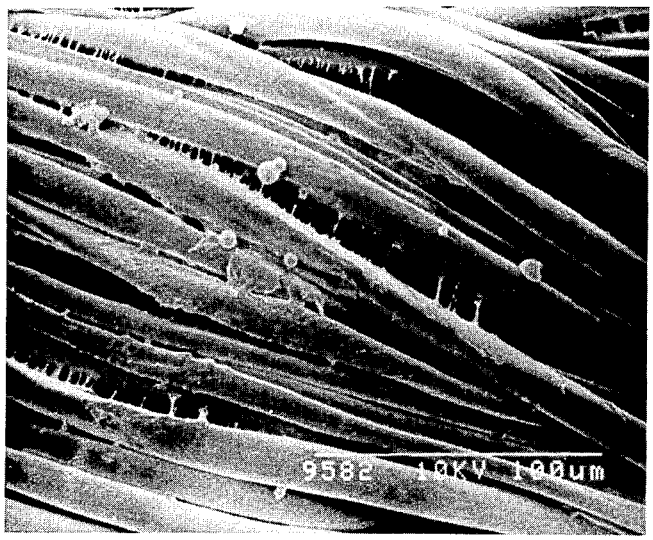
FIGS. 2 and 3 are photomicrographs of 500 magnifications showing the form of fibers in a cotton plain woven fabric with microcapsules adhered thereto.
Figure 2B:
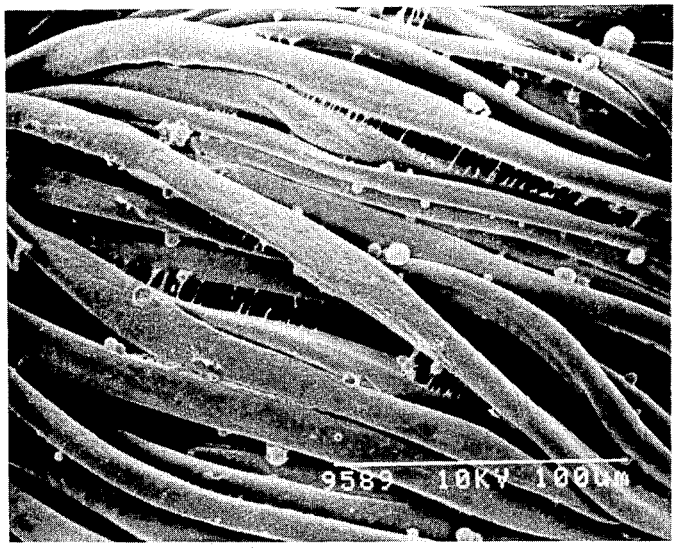
Figure 2C:
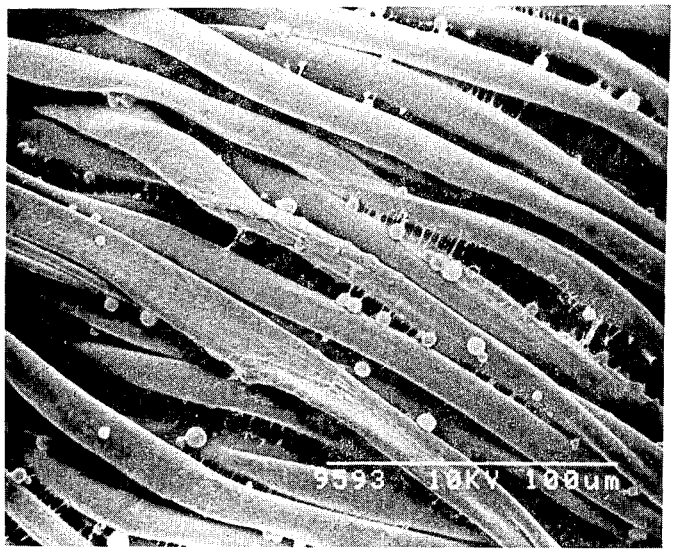

The test results of tearing strength and durability of the fragrance of the obtained cotton plain weave fabric are shown in Table 6. Additionally, magnified views of fibers in respective cotton plain weave fabrics are shown in FIG. 2, (A), (B) and (C).

COMPARATIVE EXAMPLE 3

A printing paste having a viscosity of 5800 cps (measured with BM type viscometer at 20° C.) was prepared from 1% by weight of an aqueous dispersion containing 47% by weight of microcapsules with a particle diameter of 5~15μ (average 10μ) composed of an external wall of a urea-formaldehyde resin enclosing 92% by weight of Fragrance SH-3037, 5% by weight of Binder LE-25 (trade name of an acrylic binder manufactured by Hayashi Chemicals Industry Co., Ltd.) and 94% by weight of an aqueous sizing agent comprising 5% by weight of Fine Gum HE (trade name of a carboxy methyl cellulose manufactured by Dai-ichi Kogyo Seiyaku Co., Ltd.).

The same cotton plain weave fabric as that used in Example 8 was screen-printed with the above printing paste by a 120 mesh flat screen and then dried at 130° C. for 1 minute.

Figure 3:
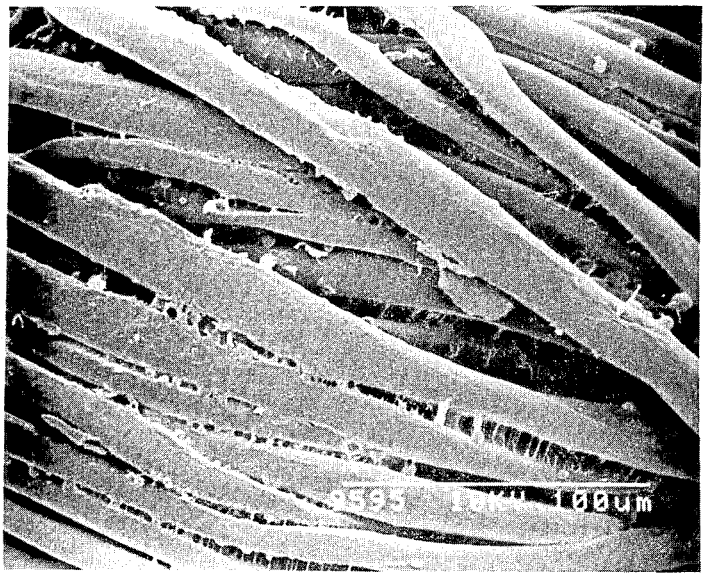

The test results of tearing strength and durability of the fragrance and of the obtained cotton plain weave fabric are shown in Table 6. Additionally, a magnified view of fibers in the cotton plain weave fabric after the treatment is shown in FIG. 3.

TABLE 6

| | Weft Tearing Strength (g) | Fragrance | | |
|---|---|---|---|---|
| | | Initial | 3 washings | 5 washings |
| Control | 640 | — | — | — |
| Example 8-A | 672 | 4.3 | 4.1 | 3.1 |
| Example 8-B | 654 | 4.7 | 4.5 | 3.9 |
| Example 8-C | 650 | 4.8 | 4.7 | 4.2 |
| Comparative Example 3 | 520 | 2.1 | 1.2 | 0 |

EXAMPLE 9

One and five-tenths percent by weight of an aqueous dispersion containing 52% by weight of micro capsules with a particle diameter of 8~18μ (average 12μ) composed of an external wall of a melamine-formaldehyde resin enclosing 88% by weight of a musk type perfume (a synthetic perfume manufactured by Takasago International Corporation), 3% by weight of KM 2002T and 10% by weight of a pressure absorbing agent comprising 5% by weight of a $C_{17}H_{35}$ alkyl terminated polyethylene glycol having a molecular weight of 22,000, were incorporated into water to prepare an aqueous treating bath.

The same Fuji silk plain weave fabric as that used in Example 5 was padded at a pickup rate of 80% by weight with the above resultant treating bath and then dried at 120° C. for 2 minutes.

The test results of tearing strength and durability of the fragrance of the obtained Fuji silk fabric are shown in Table 7.

COMPARATIVE EXAMPLE 4

One and five-tenths percent by weight of an aqueous dispersion containing 52% by weight of microcapsules with a particle diameter of 8~18μ (average 12μ) composed of an external wall of a melamine-formaldehyde resin enclosing 88% by weight of a musk type perfume (a synthetic perfume manufactured by Takasago International Corporation) and 3% by weight of Voncoat R-136 (trade name of an acrylic binder manufactured by Dainippon Ink & Chemicals Co., Ltd.) were incorporated into water to prepare an aqueous treating bath.

The same Fuji silk plain weave fabric as that used in Example 5 was padded at a pickup rate of 80% by weight with the above resultant treating bath and then dried a 120° C. for 2 minutes.

The test results of tearing strength and durability of the fragrance of the obtained Fuji silk fabric are also shown in Table 7.

COMPARATIVE EXAMPLE 5

The test fabric obtained in Comparative Example 4 was continually subjected to a further heat treatment at 150° C. for 3 minutes.

With regard to the obtained Fuji silk fabric, the test results of tearing strength and durability of the fragrance are also shown in Table 7.

TABLE 7

| | Weft Tearing Strength (g) | Fragrance | | |
|---|---|---|---|---|
| | | Initial | 3 Dry cleanings | 10 Dry cleanings |
| Control | 1380 | — | — | — |
| Example 9 | 1820 | 4.3 | 3.8 | 2.9 |
| Comparative Example 4 | 1410 | 1.8 | 0.3 | 0 |
| Comparative Example 5 | 1130 | 1.2 | 0.9 | 0.3 |

EXAMPLE 10

A dyed plain weave 75% cotton and 25% polyester blend fabric, having a weight of 82 g/m$^2$, a yarn density of Ne 60 warp×Ne 60 weft being 96×72/inch was obtained through conventional scouring, bleaching, mercerizing, heat-setting and dyeing processes.

This plain weave fabric was treated in the same manner as that in Example 8.

The test results of tearing strength and durability of the fragrance of the obtained plain weave fabric are shown in Table 8.

TABLE 8

| | Weft Tearing Strength (g) | Fragrance | | |
|---|---|---|---|---|
| | | Initial | 3 washings | 10 washings |
| Control | 831 | — | — | — |
| Example 10-A | 920 | 4.2 | 3.9 | 2.8 |
| Example 10-B | 980 | 4.6 | 4.2 | 3.4 |
| Example 10-C | 903 | 4.5 | 4.0 | 3.7 |

EXAMPLE 11

A dyed cotton plain weave fabric having a weight of 108 g/m$^2$, a yarn density of Ne 40 warp×Ne 40 weft being 90×75/inch was obtained through conventional scouring, bleaching, mercerizing and dyeing processes.

On the other hand, three kinds of printing pastes (A), (B) and (C) were prepared from (A) 0.2%, (B) 0.5% and (C) 2.0%, by weight, respectively, of an aqueous dispersion containing 48% by weight of microcapsules with a particle diameter of 7~16μ (average 12μ) composed of an external wall of a melamine-formaldehyde resin enclosing 93% by weight of Fragrance BA-9185 (trade name of a citrus type synthetic perfume manufactured by Takasago International Corp.), 5% by weight of Elastron M-2076 (trade name of a blocked isocyanate of polysaccharide emulsion manufactured by Dai-ichi Kogyo Seiyaku Co., Ltd.), 0.5% by weight of Elastro Cayalyst 32 (trade name of a fatty acid metallic salt catalyst manufactured by Dai-ichi Kogyo Seiyaku Co., Ltd.) and (A) 94.3%, (B) 94.0% and (C) 92.5%, by weight, respectively, of an aqueous pressure absorbing agent comprising 5% by weight of sodium polyacrylate having a molecular weight of 720,000.

After adjusting the pH of the resulting printing pastes with sodium bicarbonate to 9, the aforementioned dyed cotton plain weave fabric was screen-printed with each of the above printing pastes by a 120 mesh flat screen and then heat-treated at 120° C. for 1 minute and at 130° C. for 2 minutes and 30 seconds.

The test results of tearing strength and durability of the fragrance of the obtained cotton plain weave fabric are shown in Table 9.

COMPARATIVE EXAMPLE 6

Three kinds of printing pastes (A), (B) and (C) were prepared from (A) 0.2%, (B) 0.5% and (C) 2.0%, by weight, respectively, of an aqueous dispersion containing 48% by weight of microcapsules with a particle diameter of 7~16μ (average 12μ) composed of an external wall of a melamine-formaldehyde resin enclosing 93% by weight of Fragrance BA-9185, 5% by weight of Elastron M-2076, 0.5% by weight of Elastron Cayalyst 32 and (A) 94.3%, (B) 94.0% and (C) 92.5% by weight, respectively, of a sizing agent comprising 5% by weight of Fine Gum HE.

After adjusting the pH of the resulting printing pastes with sodium bicarbonate to 9, the same dyed cotton plain weave fabric as that used in Example 11 was screen-printed with each of the above printing pastes by a 120 mesh flat screen and then dried at 120° C. for 1 minute.

The test results of tearing strength and durability of the fragrance of the obtained cotton plain weave fabric are also shown in Table 9.

COMPARATIVE EXAMPLE 7

Three kinds of printing pastes (A), (B) and (C) were prepared from (A) 0.2%, (B) 0.5% and (C) 2.0%, by weight, respectively, of an aqueous dispersion containing 48% by weight of microcapsules with a particle diameter of 7~16μ (average 12μ) composed of an external wall of a melamine-formaldehyde resin enclosing 93% by weight of Fragrance BA-9185, 5% by weight of Voncoat R-3020 and (A) 94.8%, (B) 94.5% and (C) 93.0%, by weight, respectively, of an aqueous pressure absorbing agent comprising 5% by weight of sodium polyacrylate having a molecular weight of 720,000.

The same dyed cotton plain weave fabric as that used in Example 11 was screen-printed with each of the above printing pastes by a 120 mesh flat screen and then dried at 120° C. for 1 minute.

The test results of tearing strength and durability of the fragrance of the obtained cotton plain weave fabric are also shown in Table 9.

TABLE 9

| | Weft Tearing Strength (g) | Fragrance | | |
|---|---|---|---|---|
| | | Initial | 3 washings | 5 washings |
| Control | 870 | — | — | — |
| Example 11-A | 880 | 4.1 | 3.5 | 2.9 |
| Example 11-B | 910 | 4.6 | 4.0 | 3.9 |
| Example 11-C | 900 | 4.9 | 4.2 | 4.1 |
| Comparative Example 6-A | 750 | 2.1 | 1.0 | 0.8 |
| Comparative Example 6-B | 770 | 2.4 | 1.2 | 1.0 |
| Comparative Example 6-C | 740 | 3.0 | 2.3 | 2.1 |
| Comparative Example 7-A | 880 | 4.2 | 1.8 | 0.2 |
| Comparative Example 7-B | 900 | 4.6 | 2.3 | 0.3 |
| Comparative Example 7-C | 900 | 4.8 | 3.0 | 0.9 |

EXAMPLE 12

A dyed Fuji silk plain weave fabric having a weight of 62 g/m$^2$, a yarn density of N 140/2 spun silk warp ×N 66 spun silk weft being 114×89/inch was obtained through conventional scouring, bleaching, mercerizing and dyeing processes.

On the other hand, 1% by weight of an aqueous dispersion containing 46% by weight of microcapsules with a particle diameter of 5~15μ (average 10μ) composed of an external wall of a urea-formaldehyde resin enclosing91% by weight of Fragrance BA-7985, 5% by weight of Elastron M-1039B (trade name of a blocked isocyanate of fluorinated acrylic emulsion manufactured by Dai-ichi Kogyo Seiyaku Co., Ltd.), 0.5% by weight of Elastron Cayalyst 32 and 5% by weight of a pressure absorbing agent comprising 5% by weight of a $C_{17}H_{35}$ alkyl terminated polyethylene glycol having a molecular weight of 22,000, were incorporated into water to prepare an aqueous treating liquid. After adjusting the pH of the resulting treating bath with sodium bicarbonate to 9, the aforementioned dyed Fuji silk plain weave fabric was padded at a pickup rate of 60% by weight with the treating bath and then dried at 120° C. for 2 minutes, followed by a heat treatment at 130° C. for 2 minutes.

The test results of tearing strength and durability of the fragrance of the obtained Fuji silk fabric are shown in Table 10.

COMPARATIVE EXAMPLE 8

One percent by weight of an aqueous dispersion containing 46% by weight of microcapsules with a particle diameter of 5~15μ (average 10μ) composed of an external wall of a urea-formaldehyde resin enclosing 91% by weight of Fragrance BA-7985, 5% by weight of Voncoat R-510 (trade name of an acrylic binder manufactured by Dainippon Ink and Chemicals Co., Ltd.), and 5% by weight of a pressure absorbing agent comprising 5% by weight of a $C_{17}H_{35}$ alkyl terminated polyethylene glycol having molecular Weight of 22,000, were incorporated into water to prepare an aqueous treating bath.

The same Fuji silk fabric as that used in Example 11 was padded at a pickup rate of 70% by weight with the above obtained treating bath and then dried at 120° C. for 2 minutes, followed by a heat treatment at 130° C. for 2 minutes.

The test results of tearing strength and durability of the fragrance of the obtained Fuji silk fabric are also shown in Table 10.

TABLE 10

| | Weft Tearing Strength (g) | Fragrance | | |
|---|---|---|---|---|
| | | Initial | 3 Dry cleanings | 10 Dry cleanings |
| Control | 1380 | — | — | — |
| Example 12 | 1450 | 4.8 | 4.5 | 3.9 |
| Comparative Example 8 | 1400 | 4.7 | 1.8 | 0.9 |

EXAMPLE 13

Three kinds of printing pastes (A), (B) and (C) were prepared from (A) 0.2%, (B) 1.0% and (C) 3.0%, by weight, respectively, of an aqueous dispersion containing 46% by weight of microcapsules with a particle diameter of 5~15μ (average 10μ) composed of an external wall of a urea formaldehyde resin enclosing 91% by weight of Fragrance BA 7985, 5% by weight of Yodosol A 1209 (trade name of an acrylic emulsion binder manufactured by Kanebo NSC, Ltd.), and (A) 94.8%, (B) 94.0% and (C) 92.0%, by weight, respectively, of an aqueous pressure absorbing agent comprising 5% by weight of sodium polyacrylate having a molecular weight of 720,000.

The same dyed cotton plain weave fabric as that used in Example 11 was screen-printed with each of the above printing pastes by a 120 mesh flat screen and then dried at 130° C. for 1 minute.

The test results of tearing strength and durability of the fragrance of the obtained cotton plain weave fabric are shown in Table 11.

COMPARATIVE EXAMPLE 9

Three kinds of printing pastes (A), (B) and (C) were prepared from (A) 0.2%, (B) 1.0% and (C) 3.0%, by weight, respectively, of an aqueous dispersion containing 46% by weight of microcapsules with a particle diameter of 5~15μ (average 10μ) composed of an external wall of a urea-formaldehyde resin enclosing 91% by weight of Fragrance BA-7985, 5% by weight of Yodosol A 1209, and (A) 94.8%, (B) 94.0% and (C) 92.0%, by weight, respectively, of an aqueous sizing agent comprising 5% by weight of Fine Gum HE (trade name of a carboxy methyl cellulose, manufactured by Dai-ichi Kogyo Seiyaku Co., Ltd.).

The same dyed cotton plain weave fabric as that used in Example 11 was screen-printed with each of the above printing pastes by a 120 mesh flat screen and then dried at 130° C. for 1 minute.

The test results of tearing strength and durability of the fragrance of the obtained cotton plain weave fabric are also shown in Table 11.

TABLE 11

| | Weft Tearing Strength (g) | Fragrance | | |
|---|---|---|---|---|
| | | Initial | 3 washings | 5 washings |
| Control | 870 | — | — | — |
| Example 13-A | 920 | 4.2 | 3.9 | 2.9 |
| Example 13-B | 890 | 4.5 | 4.2 | 3.0 |
| Example 13-C | 900 | 4.8 | 4.7 | 4.7 |
| Comparative Example 9-A | 930 | 1.2 | 0.8 | 0.3 |
| Comparative Example 9-B | 900 | 2.2 | 1.4 | 0.7 |
| Comparative Example 9-C | 890 | 3.0 | 2.2 | 1.4 |

EXAMPLE 14

Two percent by weight of an aqueous dispersion containing 48% by weight of microcapsules with a particle diameter of 4~14μ (average 9.5μ) composed of an external wall of a urea-formaldehyde resin enclosing 89% by weight of sandalwood oil (a synthetic perfume, manufactured by Takasago International Corporation), 5% by weight of Superflex E-2000 (trade name of a polyurethane emulsion, manufactured by Dai-ichi Kogyo Seiyaku Co., Ltd.), and 8% by weight of a pressure absorbing agent comprising 5% by weight cf a $C_{17}H_{35}$ alkyl terminated polyethylene glycol having a molecular weight of 22,000, were incorporated into water to prepare an aqueous treating bath.

The same printed Fuji silk fabric as that used in Example 5 was padded at a pickup rate of 70% by weight with the above obtained treating bath and then dried at 120° C. for 2 minutes, followed by a heat treatment at 130° C. for 1 minute.

The test results of tearing strength and durability of the fragrance of the obtained Fuji silk fabric are shown in Table 12.

COMPARATIVE EXAMPLE 10

The same printed Fuji silk fabric as that used in Example 5 was padded at a pickup rate of 70% by weight with an aqueous treating bath comprising 2% by weight of an aqueous dispersion containing microcapsules composed of an external wall of a urea-formaldehyde resin enclosing 89% by weight of sandalwood oil (a synthetic perfume manufactured by Takasago International Corporation) and 5% by weight of Superflex E-2000, and then dried at 120° C. for 2 minutes, followed by a heat treatment at 130° C. for 1 minute. The test results of tearing strength and durability of the fragrance of the obtained Fuji silk fabric are also shown in Table 12.

TABLE 12

| | Weft Tearing Strength (g) | Fragrance | | |
|---|---|---|---|---|
| | | Initial | 3 Dry cleanings | 10 Dry cleanings |
| Control | 1380 | — | — | — |
| Example 14 | 1430 | 4.8 | 4.6 | 3.9 |
| Comparative Example 10 | 1350 | 3.5 | 1.2 | 0.5 |

EXAMPLE 15

A printed cotton plain weave fabric having a weight of 108 g/m² and a yarn density of Ne 40 warp×Ne 40 weft being 90×75/inch was obtained through conventional scouring, bleaching, mercerizing and dyeing processes.

On the other hand, three kinds of printing pastes (A), (B) and (C) were prepared from (A) 0.2%, (B) 1.0% and (C) 3.0%, by weight, respectively, of an aqueous dispersion containing 46% by weight of micro-capsules with a particle diameter of 5~15μ (average 10μ) composed of an external wall of a ureaformaldehyde resin enclosing 91% by weight of Fragrance BA-7985, 5% by weight of Yodosol PE-400 and (A) 95%, (B) 94.0% and (C) 92.0%, by weight, respectively, of an aqueous pressure absorbing agent comprising 5% by weight of sodium polyacrylate having a molecular weight of 720,000.

The abovementioned dyed cotton plain weave fabric was screen-printed with each of the above printing pastes by a 120 mesh flat screen and then dried at 130° C. for 1 minute.

The test results of tearing strength and durability of the fragrance of the obtained cotton plain weave fabric are shown in Table 13.

TABLE 13

| | Weft Tearing Strength (g) | Fragrance | | |
|---|---|---|---|---|
| | | Initial | 3 washings | 5 washings |
| Control | 870 | — | — | — |
| Example 15-A | 920 | 4.0 | 3.5 | 2.7 |
| Example 15-B | 980 | 4.3 | 4.1 | 3.0 |
| Example 15-C | 950 | 4.4 | 4.1 | 3.6 |

EXAMPLE 16

Two percent by weight of an aqueous dispersion containing 48% by weight of microcapsules with a particle diameter of 4~14μ (average 9.5μ) composed of an external wall of a urea formaldehyde resin enclosing 89% by weight of sandalwood oil (a synthetic perfume manufactured by Takasago International Corporation), 5% by weight of Finetex ES-675 (trade name of a polyester emulsion manufactured by Dainippon Ink & Chemicals Co., Ltd.) and 8% by weight of a pressure absorbing agent comprising 5% by weight of a $C_{17}H_{35}$ alkyl terminated polyethylene glycol having a molecular Weight of 22,000, were incorporated into water to prepare an aqueous treating bath.

The same printed Fuji silk plain weave fabric as that used in Example 5 was padded at a pickup rate of 70% by weight with above obtained treating bath and then dried at 120° C. for 2 minutes, followed by a heat treatment at 130° C. for 1 minute.

The test results of tearing strength and durability of the fragrance of the obtained Fuji silk fabric are shown in Table 14.

TABLE 14

| | Weft Tearing Strength (g) | Fragrance | | |
|---|---|---|---|---|
| | | Initial | 3 Dry cleanings | 10 Dry cleanings |
| Control | 1380 | — | — | — |
| Example 16 | 1480 | 4.5 | 3.9 | 3.1 |

EXAMPLE 17

A 2/2 twill fabric having a yarn density of warp x weft being 110x90/inch was woven with a warp of 75d/72f polyester yarn and a weft of 100d/50f polyamide/polyester fibrillating type composite filament yarn having a cross-sectional shape as shown in FIG. 1, (8).

The above fabric was pad-nipped at a pickup rate of 60% by weight with an aqueous solution (30° C.) containing 10% by weight of benzyl alcohol and 1% by weight of Sunmorl BK conc. (trade name of a emulsifier manufactured by Nikka Chemicals Co., Ltd.) and left to stand at room temperature for 10 minutes. Then, after repeating only the nipping 5 times, the fabric was washed with warm water at 70° C. for about 2 minutes and dried. The weft yarns of the fabric were fibrillated into a fineness of monofilaments of about 0.1~0.2 denier and the yarn density of the fabric became 170×100/inch (the number of the weft was counted as original yarn). This fabric was heat-set at 190° C. and dyed to provide a fibrous structure to be used in the present invention.

On the other hand, microcapsules having a diameter of about 5~10μ, consisting of 20% by weight of an external wall of a urea-formaldehyde resin and 80% by weight of an internal phase of fragrant oil were prepared.

The above obtained fibrous structure was pad-nipped at a pickup rate of 60% by weight with an aqueous dispersion containing 1% by weight of the microcapsules and 0.5% by weight of Elastron F 29 (trade name of a urethane elastomer manufactured by Dai-ichi Kogyo Seiyaku Co., Ltd.), and dried at 120° C.

The thus treated fibrous structure was tested for the durability of the fragrance by repeatedly washing in accordance with JIS L 1042. The scent was clearly recognized until after 8 washings. For the purpose of comparison, a polyester twill fabric containing no fibrillating type composite fibers was treated in the same manner as described above. Then, the scent was recognized after one washing but hardly recognized after two washings.

EXAMPLE 18

Using a 40d/25f fibrillating type composite filament yarn, an interlock knitted fabric (wale×course=50×60) was knit with a 40 gauge circular knitting machine.

The above knitted fabric was pad-nipped at a pickup rate of 100% by weight) with an aqueous solution (30° C.) containing 20% by weight of benzyl alcohol and 2.0% by weight of an emulsifier. The above pad nipping was conducted once again. Then, the fabric was soaked for 20 minutes in hot water at 80° C. under a relaxed state to effect shrinking of the fabric and removal of benzyl alcohol, and then dried. The area of shrinkage of the fabric was 60%.

On the other hand, an aqueous dispersion of 0.5% by weight of the same microcapsules as those used in Example 17 (not containing a binder resin) was put into a pan. The bottom of a horizontal application steel roll engraved with fine grooves was dipped in the aqueous dispersion and a rubber roll was placed in parallel upon the steel roll to form a nip.

By passing through the nip, the above knitted fabric was applied with the microcapsule aqueous dispersion and continuously dried at 100° C.

The durability of the fragrance was tested in the same manner as Example 17 and the scent was clearly recognized after 5 washings. For the purpose of comparison, a polyester knitted fabric knit with an ordinary 40d/25f polyester filament yarn, i.e., not fibrillating type composite filament yarn, was tested and substantially no scent was recognized.

EXAMPLE 19

The yarns listed hereinbelow were subjected to a water repellent treatment, according to a conventional process, with the water repellent softening agent used in Example 1. Further, 2 g/l aqueous dispersion of the perfume containing microcapsules was admixed with 5 g/l of the silicone aqueous emulsion both used in Example 1. Then, the yarns were soaked in the above mixture at a microcapsule pickup of 0.45% by weight and dried at 90° C. for 20 minutes, followed by a dry heat treatment at 130° C. for 30 seconds. The wool yarns for hand knitting or for fancywork to which the microcapsules containing the perfume were adhered were forwarded to finishing and setting steps to prepare fragrant wool yarns for hand knitting or for fancywork, according to a conventional process.

① Wool yarn for hand knitting composed of a 12 count/4 ply woolly yarn.

② Wool yarn for hand knitting composed of an 18 count/4 ply woolly yarn.

③ Woolly yarn for hand knitting composed of a 15 count/4 ply blend yarn of 50% wool and 50% porous acrylic.

④ Yarn for fancywork composed of a 16/3 Ne cotton yarn.

⑤ Yarn for fancywork composed of a 16/3 Ne blend yarn of 50% cotton and 50% porous acrylic.

⑥ Yarn for lacework composed of a 50/3 Ne cotton yarn.

These yarns were tested for resistance to washing in accordance with JIS L 0217, No. 106, and hand in the same manner as Example 1. The results are shown in Table 15.

TABLE 15

| | Resistance to Washing (Frequency) | Fragrance | Hand |
|---|---|---|---|
| ① Hand knitting wool yarn | 9 | O(−1∼1) | O(0∼−1) |
| ② Hand knitting wool yarn | 8 | O(−1∼1) | O(0∼−1) |
| ③ Hand knitting wool yarn | 14 | O(−1∼1) | O(0∼−1) |
| ④ Fancywork yarn | 10 | O(−1∼1) | O(0∼−1) |
| ⑤ Fancywork yarn | 12 | O(−1∼1) | O(0∼−1) |
| ⑥ Lacework yarn | 7 | O(−1∼1) | O(0∼−1) |

From the results shown in Table 15 above, it will be clear that the fragrant wool yarns for hand knitting or yarns for fancywork according to the present invention have achieved the object of the invention, namely, they possess a durable, pleasant scent as well as a good hand.

EXAMPLE 20

The below described five kinds of dyed fabrics were subjected to a water repellent treatment followed by a fragrant microcapsule adhering treatment in the same manner as those in Example 1 and then dried and set by finishing according to conventional processes, to produce fragrant fabrics.

① A 28 gauge 2 bar fancy fabric knit with the back of a 75d/36f circular cross-sectional polyester yarn and the front of 3 kinds of polyester yarns, circular cross-sectional, trilobal cross-sectional and cation dyeable, respectively.

② A French back napped fabric woven with the back of a 75d/36f circular cross-sectional polyester yarn and the front of 3 kinds of polyester yarns, circular cross sectional, trilobal cross-sectional and cation dyeable, respectively.

③ A velour woven with the back and middle of a 75d/36f circular cross-sectional polyester yarn and the front of 2 kinds of polyester yarns, circular cross-sectional and cation dyeable.

④ A stretchable twill fabric woven with the back and middle of a 50d/24f circular cross-sectional PBT texturized yarn and a 50d/24f circular cross-sectional polyester yarn, respectively, and the front of a 75d/36f circular cross-sectional polyester yarn.

⑤ A raschel lace knit with a 75d/36f circular cross-sectional polyester yarn and an insertion yarn of an Ne 60/3 ply-twisted polyester/cotton blend yarn.

Then, the above fabrics ①, ② and ③ were made up into car sheets, the fabric 4 into a side material and the fabrics ④ and ⑤ into sheet covers. Then, these articles were tested for resistance to washing and hand. Hereupon, the test for resistance to washing was carried out in accordance with JIS L 0217, No. 103 and determined by the washing frequency until fragrance has vanished. The result is shown in Table 16.

TABLE 16

| | Microcapsules: Binder | Application Method | Add-on (%) | Resistance to Washing (Frequency) | Fragrance | Hand |
|---|---|---|---|---|---|---|
| ① Car sheet | 1:1 | Padding | 1.4 | — | O(−1∼1) | O(0∼−1) |
| ② Car sheet | 1:1 | Padding | 1.4 | — | O(−1∼1) | O(0∼−1) |
| ③ Car sheet | 1:1 | Padding | 1.4 | — | O(−1∼1) | O(0∼−1) |
| ④ Side material | 1:1 | Padding | 1.4 | — | O(−1∼1) | O(1∼−1) |
| ① Car sheet | 1:2 | Back coating | 2.1 | — | O(−1∼1) | O(0∼−1) |
| ④ Sheet cover | 1:1 | Padding | 1.4 | 10 | O(−1∼1) | O(0∼−1) |
| ⑤ Sheet cover | 1:1 | Soaking | 1.4 | 8 | O(−1∼1) | O(0∼−1) |
| ④ Sheet cover (no water repellent treatment) | 1:1 | Padding | 1.4 | 12 | O(−1∼1) | Δ(−1∼−2) |

EXAMPLE 21

Using nylon 6 staples having a fineness of 1.0 denier and a fiber length of 51 mm, a web was prepared with a carding machine and a cross-lapper. This web was then needle-punched to provide a three dimensional nonwoven fabric having a weight of 150 g/m$^2$, a thickness of 1.0 mm and an apparent density of 0.15 g/cm$^3$.

This nonwoven fabric was impregnated with a dimethyl formamide solution of 16% polyurethane elastomer at a solution pickup rate of about 500% based on the weight of the fabric, and then soaked in a coagulating bath at 40° C. (water: dimethyl formamide=80:20 by weight) to coagulate the polyurethane. Then after desolvating by soaking in warm water at 60° C. for 2 hours, hot air drying at 120° C. was conducted to provide a substrate loaded with a polyurethane elastomer.

The thus obtained substrate had a weight of 280 g/m$^2$, a thickness of 1.0 mm and an apparent density of 0.28 g/cm$^3$.

Then, microcapsules having a particle diameter of 5∼10μ (average 8μ) composed of an external wall of a urea-formaldehyde resin encapsulating 80% by weight of Fragrance BA-7985 (a jasmine type synthetic perfume) were admixed with a dimethyl formamide solution of 25% polyurethane elastomer same as the above in an amount of 6% based on the weight of the polyurethane elastomer. The resulting solution was applied by doctor-coating onto the surface of the aforementioned substrate at a coating ratio of 400 g/m$^2$ and then soaked in a coagulating bath (water: dimethyl formamide=80:20 by weight) at 40° C. for 30 minutes followed by soaking in warm water at 60° C. for 2 hours, thoroughly washing with water and hot air drying at 100° C., to provide a synthetic leather substitute having a grain side.

In accordance with the present invention, synthetic leather substitutes excellent in fragrance can be manufactured without requiring any special contrivance in process steps such as a coagulation step or the like. Furthermore, the obtained synthetic leather substitutes compare favorably with those not incorporated with fragrant microcapsules, in physical properties such as flexing resistance.

What is claimed is:

1. A fragrant fibrous structure which has microcapsules encapsulating a perfume adhered thereto by a resinous binder, the weight ratio of said microcapsules to said resinous binder being between 2:1 and 1:5, and the sum of the amounts of said microcapsules and resinous binder being between 0.3 and 7.0%, based on the weight of the portion of the fibrous structure to which said microcapsules and resinous binder are adhered.

2. A fragrant fibrous structure as claimed in claim 1, wherein said weight ratio is between 1:1 and 1:3 and the sum of said amounts is between 0.5 and 5.0% by weight.

3. A fragrant fibrous structure as claimed in claim 1, wherein said microcapsules are composed of an external wall comprising a formaldehyde based resin selected from the group consisting of a urea-formaldehyde resin and a melamine-formaldehyde resin.

4. A fragrant fibrous structure as claimed in claim 1, wherein said resinous binder contains a pressure absorbing agent.

5. A fragrant fibrous structure as claimed in claim 1, wherein said resinous binder comprises a silicone resin.

6. A fragrant fibrous structure as claimed in claim 1, wherein said resinous binder comprises an acrylic or methacrylic resin.

7. A fragrant fibrous structure as claimed in claim 1, wherein said resinous binder comprises a polyalkylene.

8. A fragrant fibrous structure as claimed in claim 1, wherein said resinous binder comprises a polyester resin formed from a polyhydric alcohol and a polybasic acid.

9. A fragrant fibrous structure as claimed in claim 1, wherein said resinous binder comprises a polyurethane formed from a diisocyanate and a polyol.

10. A fragrant fibrous structure comprising fibers having s fineness of 0.7 denier or less/filament, which retains microcapsules encapsulating a perfume in interstices of the fibrous structure.

11. A fragrant fibrous structure as claimed in claim 10, wherein said fibrous structure has an interstice ratio of 80% or less and said microcapsules have an average diameter of $1 \sim 50\ \mu$.

* * * * *